US011339515B2

(12) United States Patent
Sakuma et al.

(10) Patent No.: US 11,339,515 B2
(45) Date of Patent: May 24, 2022

(54) SEWING MACHINE

(71) Applicant: SUZUKI MANUFACTURING, LTD., Yamagata (JP)

(72) Inventors: Tohru Sakuma, Yamagata (JP); Mitsuru Sato, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 0 days.

(21) Appl. No.: 17/058,376

(22) PCT Filed: Jun. 26, 2019

(86) PCT No.: PCT/JP2019/025398
§ 371 (c)(1),
(2) Date: Nov. 24, 2020

(87) PCT Pub. No.: WO2020/136950
PCT Pub. Date: Jul. 2, 2020

(65) Prior Publication Data

US 2021/0363679 A1 Nov. 25, 2021

(30) Foreign Application Priority Data

Dec. 25, 2018 (JP) ..... JP2018-241520

(51) Int. Cl.
*D05B 27/02* (2006.01)
*D05B 27/24* (2006.01)
(Continued)

(52) U.S. Cl.
CPC ..... *D05B 27/02* (2013.01); *D05B 27/24* (2013.01); *D05B 29/02* (2013.01); *D05B 69/02* (2013.01)

(58) Field of Classification Search
CPC ..... D05B 27/02; D05B 27/08; D05B 27/24; D05B 69/02
(Continued)

(56) References Cited

U.S. PATENT DOCUMENTS 4,958,580 A * 9/1990 Asaba ..... D05B 27/02 112/323
5,477,796 A * 12/1995 Nedoschinsky ..... D05B 27/02 112/323
(Continued)

FOREIGN PATENT DOCUMENTS

DE 10321266 A1 12/2003
JP 53-124059 U 10/1978
(Continued)

OTHER PUBLICATIONS

Office Action dated Mar. 14, 2022 issued in corresponding German patent application No. 112019002214.8.

*Primary Examiner* — Nathan E Durham
(74) *Attorney, Agent, or Firm* — Bacon & Thomas, PLLC

(57) ABSTRACT

Provided is a sewing machine that can be reduced in size by employing a simple configuration for a feed dog drive device. A lateral feed drive unit (8) and a vertical drive unit (9) transmit rotation of a drive shaft (7) to a feed dog (3). The feed dog (3) is supported by a swingable feed base (5). A square piece (18) is provided at a lower end of a raising and lowering link (15) of the vertical drive unit (9). A guide member (19) including a guide groove (20) configured to guide the square piece (18) is disposed right under the feed base (5). An upper end of the raising and lowering link (15) is connected to a part of the feed base (5) between the swinging shaft (6) and the feed dog (3).

4 Claims, 7 Drawing Sheets

(51) Int. Cl.
*D05B 69/02* (2006.01)
*D05B 29/02* (2006.01)

(58) Field of Classification Search
USPC ..... 112/324
See application file for complete search history.

(56) References Cited

U.S. PATENT DOCUMENTS

| | | | | |
|---|---|---|---|---|
| 2006/0090681 | A1* | 5/2006 | Ota | D05B 27/10 112/459 |
| 2007/0227419 | A1* | 10/2007 | Hirose | D05B 27/24 112/2 |
| 2008/0121155 | A1* | 5/2008 | Fukao | D05C 9/04 112/102.5 |
| 2010/0212563 | A1* | 8/2010 | Mizuno | D05B 27/02 112/260 |
| 2017/0121878 | A1* | 5/2017 | Koike | D05B 27/08 |

FOREIGN PATENT DOCUMENTS

| | | | |
|---|---|---|---|
| JP | 56-020490 | A | 2/1981 |
| JP | 2000279671 | A | 10/2000 |
| JP | 2001347087 | A | 12/2001 |
| JP | 003202791 | U | 2/2016 |

* cited by examiner

SEWING MACHINE

TECHNICAL FIELD

The present invention relates to a sewing machine to be use for sewing of a product made of fabric as a material.

BACKGROUND ART

When a sewing operation is performed with a sewing machine, fabric is pierced with a sewing needle from above in a state where the fabric is sandwiched between a throat plate and a presser foot, and then, when the sewing needle is raised and separated from the fabric, a feed dog projects above the throat plate and feeds the fabric.

The feed dog is driven by a feed dog drive device. The feed dog drive device of this kind includes: a feed connecting rod extending in the lateral direction, the feed connecting rod being configured to support the feed dog by a distal end thereof; a feed base configured to support the feed connecting rod movably in its longitudinal direction; a swinging shaft configured to swingably support a base end of the feed base such that the feed dog provided in the distal end of the feed connecting rod is movable in the up-down direction; a drive shaft via which power from a drive source is transmitted; a lateral feed drive unit configured to convert rotation of the drive shaft into lateral feed motion and transmit it to the feed dog; and a vertical drive unit configured to convert rotation of the drive shaft into vertical motion and transmit it to the feed dog.

Hereby, when the sewing needle is placed above the throat plate, the vertical drive unit causes the feed dog to project from a top surface of the throat plate, and the lateral feed drive unit moves the feed dog forward in the feeding direction of the fabric. When the sewing needle is placed below the throat plate, the vertical drive unit retracts the feed dog below the throat plate, and the lateral feed drive unit moves the feed dog backward such that the feed dog returns to its original position.

In the meantime, when fabric is set on the throat plate prior to the sewing operation, the sewing needle is moved to above the throat plate first, and then, pressing of the fabric by the presser foot is released. The release of pressing of the fabric by the presser foot is performed by performing a raising operation on a press operation lever. Subsequently, the fabric is slid along the top surface of the throat plate, so that a sewing start position of the fabric is moved to right under the sewing needle.

However, when the sewing needle stops above the throat plate, the sewing needle stops in a state where the feed dog projects from the top surface of the throat plate. This causes such an inconvenience that the fabric is stuck to the feed dog projecting from the top surface of the throat plate, and preparations for sewing cannot be performed smoothly.

In view of this, there has been conventionally proposed a sewing machine provided with a feed dog operation clutch between an vertical drive unit and a feed dog, the feed dog operation clutch being configured to block vertical motion transmitted to the feed dog in conjunction with a raising operation on a press operation lever such that the feed dog retreats at a position below the top surface of a throat plate and to transmit vertical motion to the feed dog in conjunction with a lowering operation on the press operation lever (see Patent Literature 1).

In this configuration, by performing the raising operation on the press operation lever, the vertical motion of the feed dog is blocked by the feed dog operation clutch, so that the feed dog is brought into a state where the feed dog retracts and retreats below the throat plate even when a sewing needle is placed above the throat plate. Accordingly, when the sewing start position of fabric is moved to right under the sewing needle, preparations for sewing and so on can be performed smoothly without causing the fabric to be stuck to the feed dog.

CITATION LIST

Patent Literature

Patent Literature 1: Japanese Patent Application Laid-Open No. 2001-347087

SUMMARY OF INVENTION

Technical Problem

However, the vertical drive unit provided with the feed dog operation clutch has a complicated configuration and therefore requires, below the throat plate, a large space in which the vertical drive unit is accommodated. In the above conventional feed dog drive device, a driving arm of the vertical drive unit and the feed dog operation clutch are accommodated in a space secured outward from and below the distal end side of the feed dog. As such, the vertical drive unit provided with the feed dog operation clutch has such an inconvenience that reduction of the sewing machine in size is not achievable because it is difficult to employ a compact configuration for the feed dog drive device.

In view of the above point, an object of the present invention is to provide a sewing machine that can be reduced in size by employing a simple configuration for a feed dog drive device.

Solution to Problem

In order to achieve the object, the present invention provides a sewing machine including: a feed dog configured to project from and retract into a top surface of a throat plate; a presser foot facing an upper side of the feed dog; a press operation lever configured to separate the presser foot from and bring the presser foot into press contact with the feed dog in conjunction with lifting and lowering operations; and a feed dog drive device configured to drive the feed dog. The feed dog drive device includes: a feed connecting rod having a distal end that supports the feed dog, the feed connecting rod extending in a lateral direction; a feed base configured to support the feed connecting rod movably in a longitudinal direction of the feed connecting rod; a swinging shaft configured to swingably support a base end of the feed base such that the feed dog provided in the distal end of the feed connecting rod is movable in an up-down direction; a drive shaft via which power from a drive source is transmitted; a lateral feed drive unit configured to convert rotation of the drive shaft into lateral feed motion and transmit the lateral feed motion to the feed dog; and a vertical drive unit configured to convert rotation of the drive shaft into vertical motion and transmit the vertical motion to the feed dog. The drive shaft is disposed below the feed base. The vertical drive unit includes: an eccentric cam configured to be rotated by the drive shaft; an advance and retreat arm configured to advance and retreat in the lateral direction by the eccentric cam; a raising and lowering link having a lower end connected to the advance and retreat arm via a lower-part connecting shaft, and an upper end connected to the feed base via an upper-part connecting shaft; a square piece provided coaxially with the lower-part connecting shaft of the raising and lowering link; a guide member having a guide groove by which the square piece is linearly guided; a pivot shaft configured to turnably support the guide member; and a guide member pivot mechanism configured to change a moving distance of the feed dog in a state projecting from the throat plate by changing an inclination angle of the guide groove by turning the guide member. The guide member is disposed on one side from the drive shaft and right under the feed base. The raising and lowering link is connected to a part of the feed base between the swinging shaft and the feed dog.

With the vertical drive unit in the above configuration, rotation of the drive shaft is converted into advance and retreat motion of the advance and retreat arm in the lateral direction via the eccentric cam. The advance and retreat motion of the advance and retreat arm causes the square piece to reciprocate along the guide groove of the guide member. The lower end of the raising and lowering link is connected to the square piece via the lower-part connecting shaft, and the upper end of the raising and lowering link is connected to the feed base via the upper-part connecting shaft. Hereby, when the square piece reciprocates along the guide groove, the raising and lowering link swings, and the feed base is raised and lowered by the swinging of the raising and lowering link.

The feed dog also projects from and retracts into the throat plate along with the raising and lowering motion of the feed base. The amount of raising and lowering of the feed base varies depending on an inclination angle of the guide groove. The inclination angle of the guide groove can be changed by turning the guide member.

The inclination of the guide groove and the vertical motion of the feed dog have such a relationship that the feed dog most greatly moves vertically when the guide groove is horizontal, for example. When the guide groove is inclined so as to be gradually lowered toward the advance direction of the advance and retreat arm, the vertical motion of the feed dog becomes small without changing the moving distance of the feed dog in the lateral direction.

That is, when an inclination is given to the guide groove by turning the guide member so that the guide groove is gradually lowered toward the advance direction of the advance and retreat arm, a state where the feed dog retracts and retreats below the throat plate can be maintained without vertically moving the feed dog even when the drive shaft rotates.

Accordingly, by providing the vertical drive unit configured as described above, preparations for sewing and so on can be made smoothly without causing fabric to be stuck to the feed dog when a sewing start position of the fabric is moved to right under a sewing needle, similarly to a conventional vertical drive unit including a feed dog operation clutch.

Besides, the vertical drive unit in the present invention has a configuration in which the guide member is provided in a connecting portion between the advance and retreat arm and the raising and lowering link. Thus, the vertical drive unit in the present invention has a configuration simpler than that of the feed dog operation clutch in the conventional vertical drive unit.

In addition, the guide member can be accommodated in a relatively small space right under the feed base, and by connecting the raising and lowering link to the feed base at a position between the swinging shaft and the feed dog, a large vertical motion can be given to the feed dog by a small raising and lowering motion of the raising and lowering link. Thus, the accommodation space for the vertical drive unit can be downsized, thereby making it possible to reduce the sewing machine in size.

Further, in the present invention, the guide member pivot mechanism is constituted by a pivot link via which the press operation lever is connected to the guide member such that an operation of the press operation lever is interlocked with turning motion of the guide member, and the pivot link turns the guide member to an angle corresponding to a position of the press operation lever in the case where the press operation lever is operated.

As an example of the operation of the pivot link, the pivot link may be configured such that: in the case where the press operation lever is moved to a first position within an operable range of the press operation lever, the pivot link turns the guide member so that the guide groove is inclined at a first predetermined angle; in the case where the press operation lever is positioned at a second position within the operable range, the pivot link turns the guide member so that the guide groove is inclined at a second predetermined angle; and in the case where the press operation lever is positioned at a third position within the operable range, the third position being between the first position and the second position, the pivot link turns the guide member so that the guide groove is inclined at a third predetermined angle between the first predetermined angle and the second predetermined angle.

That is, more specifically, in the case where the guide groove is inclined at the first predetermined angle from a horizontal state by operating the press operation lever to an upper end (the first position) within its operable range, for example, the feed dog can be set to retract and retreat below the throat plate. In the case where the guide groove is inclined at the second predetermined angle from the horizontal state by operating the press operation lever to a lower end (the second position), for example, the second predetermined angle being smaller than the first predetermined angle, the feed dog can be set to a state where feeding of fabric is performed by the feed dog. Hereby, the state of the feed dog can be changed in conjunction with the operation of the press operation lever without any conscious of a user.

Further, at an intermediate position (the third position between the first position and the second position) within the operable range of the press operation lever, the guide groove is inclined at the third predetermined angle smaller than the first predetermined angle but larger than the second predetermined angle, for example, and the feed width of fabric to be fed by the feed dog can be easily changed.

Further, in the present invention, it is preferable that a center of a reciprocation region for the square piece in the guide groove deviate from an axial center for turning of the guide member to a side where the guide groove is to be lowered in the case where the guide groove is inclined. With this configuration, it is possible to more surely achieve a state where the feed dog retreats below the throat plate when the guide groove is inclined.

DESCRIPTION OF EMBODIMENTS

Figure 1:
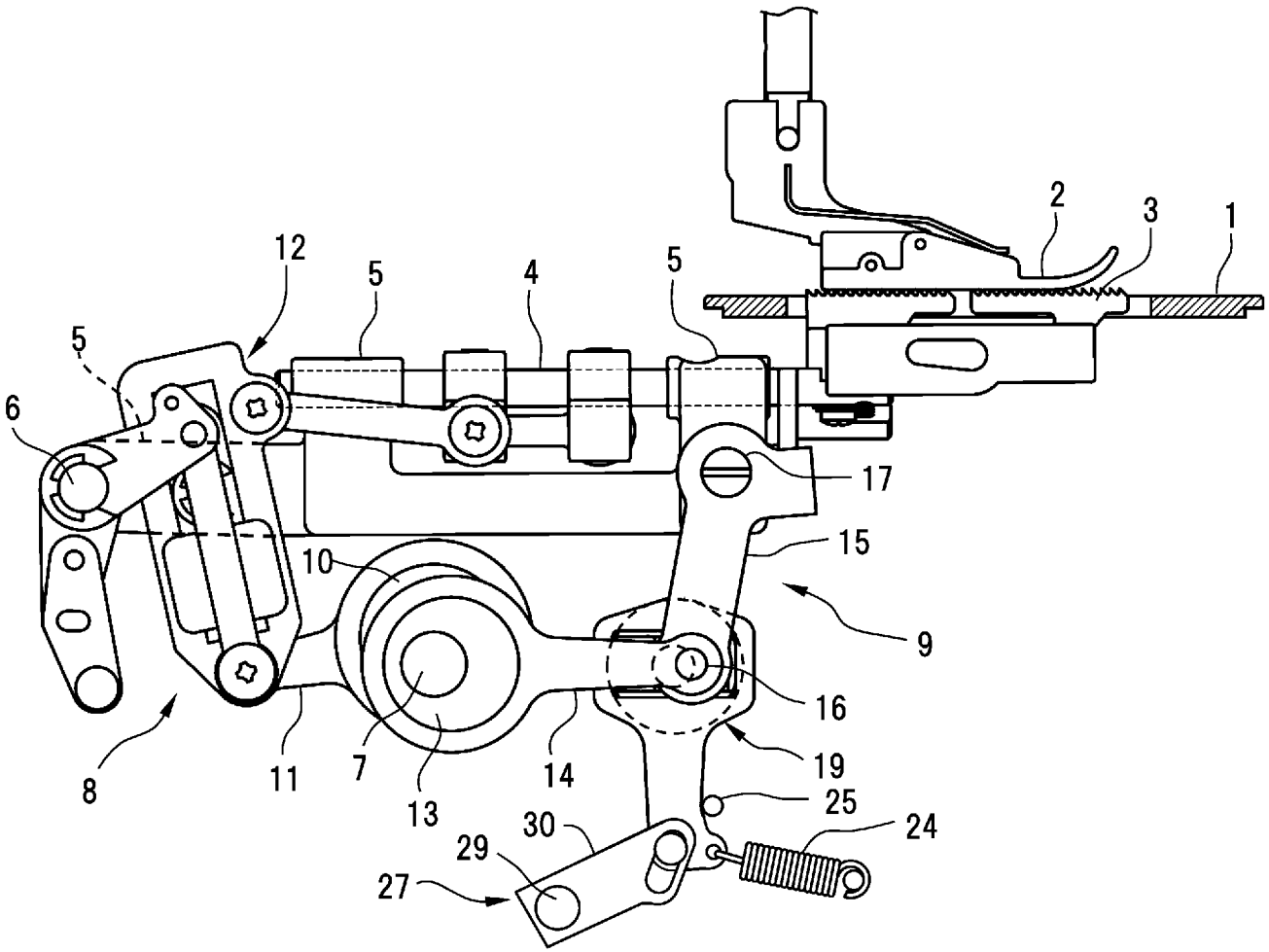
FIG. 1 is an explanatory view illustrating a configuration of an essential part of a sewing machine according to an embodiment of the present invention.

One embodiment of the present invention is described below with reference to the drawings. An overall configuration of a sewing machine of the present embodiment is not illustrated herein. However, as a configuration according to the summary of the present invention, the sewing machine includes a sewing needle (not shown) configured to reciprocate in the up-down direction, and as illustrated in FIG. 1, a throat plate 1 on which fabric such as clothing is placed, a presser foot 2 configured to press the fabric on the throat plate 1, and a feed dog 3 configured to feed the fabric by projecting from and retracting into a top surface of the throat plate 1.

The feed dog 3 is driven by a feed dog drive device. The feed dog drive device includes a feed connecting rod 4 extending in the lateral direction and a feed base 5 configured to support the feed connecting rod 4 movably in its longitudinal direction. The feed dog 3 is provided integrally with a distal end of the feed connecting rod 4.

A base end of the feed base 5 is connected to a frame (not shown) via a swinging shaft 6 such that the feed base 5 is swingable in the up-down direction. Along with swinging of the feed base 5, the feed dog 3 provided in the distal end of the feed connecting rod 4 is moved in the up-down direction. Further, the feed dog drive device includes a drive shaft 7 via which power from a drive source (not shown) is transmitted, a lateral feed drive unit 8, and a vertical drive unit 9. The drive shaft 7 is disposed below the feed base 5. The drive source also drives motion of the sewing needle.

The lateral feed drive unit 8 includes a first eccentric cam 10 configured to be rotated by the drive shaft 7, a first advance and retreat arm 11 configured to advance and retreat in the lateral direction by the first eccentric cam 10, and an advance and retreat link 12 via which advance and retreat motion of the first advance and retreat arm 11 is transmitted to the feed connecting rod 4. With the lateral feed drive unit 8 configured as such, rotation of the drive shaft 7 is converted into lateral feed motion and transmitted to the feed dog 3.

Figure 2:
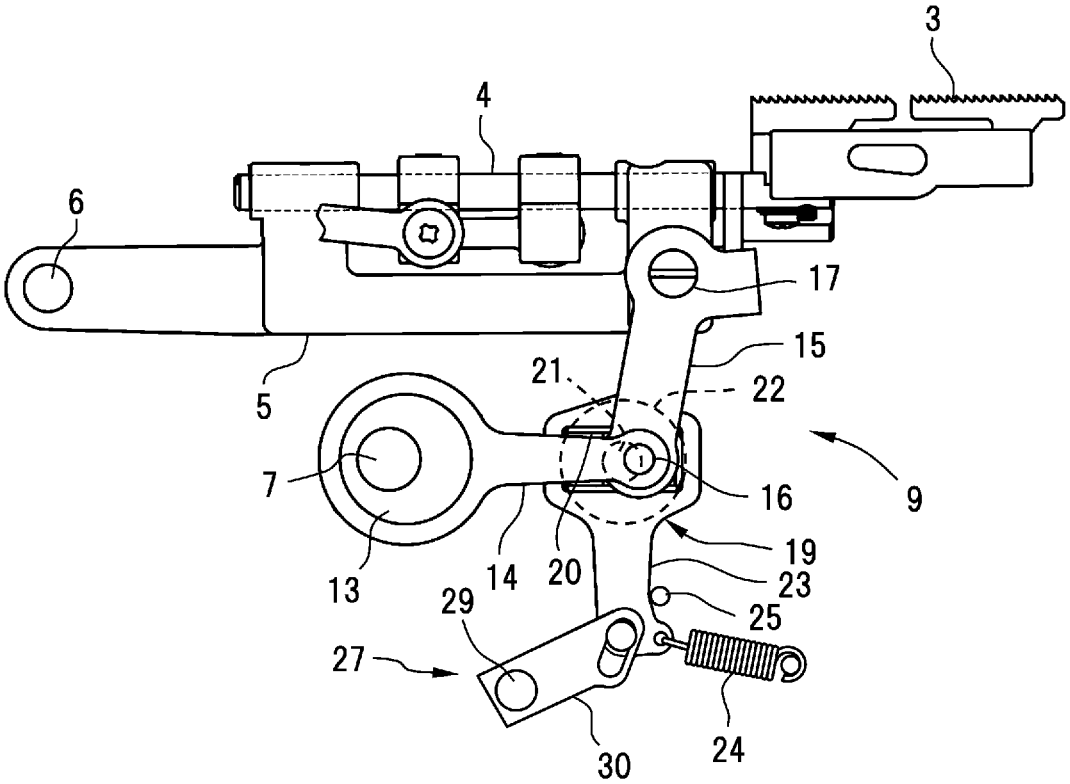
FIG. 2 is an explanatory view illustrating a configuration of a vertical drive unit.

The vertical drive unit 9 is configured to convert rotation of the drive shaft 7 into vertical motion and transmit it to the feed dog 3. As illustrated in FIGS. 1 and 2, the vertical drive unit 9 includes a second eccentric cam 13 configured to be rotated by the drive shaft 7, a second advance and retreat arm 14 configured to advance and retreat in the lateral direction by the second eccentric cam 13, and a raising and lowering link 15 connected to the second advance and retreat arm 14. The second eccentric cam 13 corresponds to an eccentric cam of the present invention, and the second advance and retreat arm 14 corresponds to an advance and retreat arm of the present invention.

As illustrated in FIG. 2, a lower end of the raising and lowering link 15 is connected to the second advance and retreat arm 14 via a lower-part connecting shaft 16, and an upper end thereof is connected to the feed base 5 via an upper-part connecting shaft 17. A square piece 18 is provided in the lower end of the raising and lowering link 15 so as to be coaxial with the lower-part connecting shaft 16.

The square piece 18 is slidably accommodated in a guide groove 20 formed in a guide member 19. The guide member 19 is disposed on one side (the right side in FIG. 2) from the drive shaft 7 and right under the feed base 5. Due to the disposition position of the guide member 19, the raising and lowering link 15 is connected to a part of the feed base 5 between the swinging shaft 6 and the feed dog 3. As a result, the vertical motion of the raising and lowering link 15 can be made small in comparison with the case where the distal end side of the feed dog 3 is raised and lowered.

Figure 3:
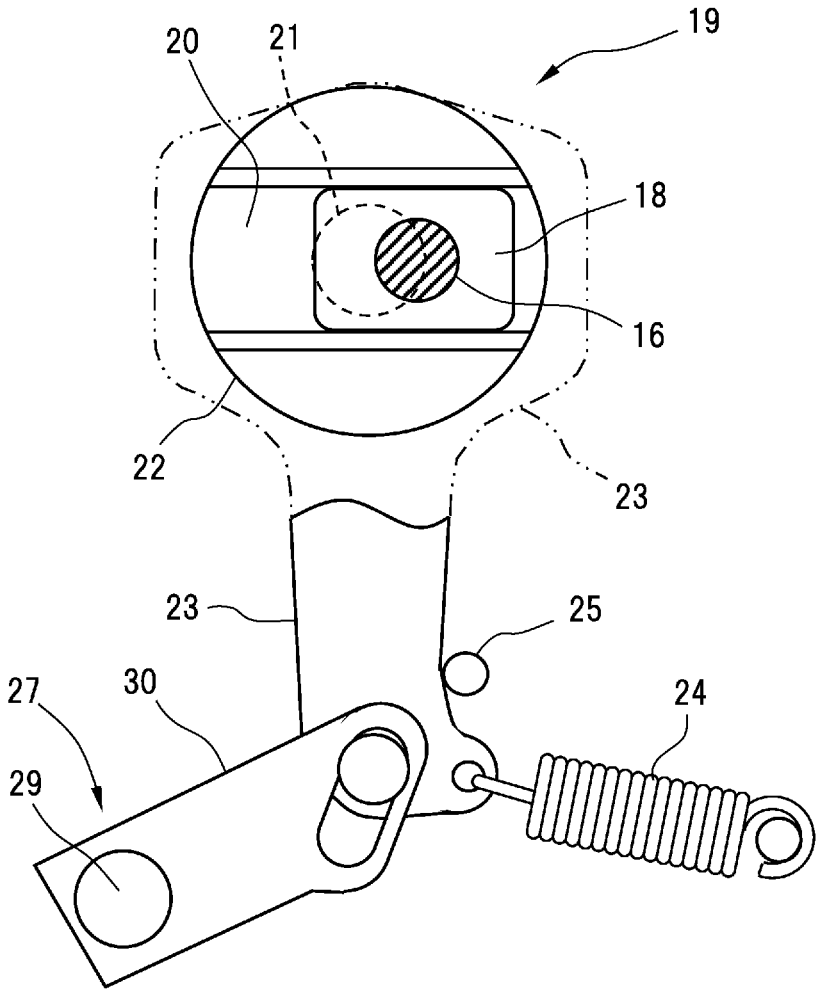
FIG. 3 is an explanatory view illustrating a configuration of a guide member.

As illustrated in FIG. 3, the guide member 19 includes a round main body block 22 including a pivot shaft 21 humbly supported by a frame (not shown).

The guide groove 20 is formed on one side surface of the main body block 22. The main body block 22 includes an extension member 23 extending radially outwardly from a part of the main body block 22. A return spring 24 is connected to the extension member 23. The return spring 24 is placed over between the extension member 23 and the frame (not shown).

Further, in FIG. 3, counterclockwise rotation of the main body block 22 from a position where the guide groove 20 has a horizontal posture is restricted by a stopper pin 25 abutting with the extension member 23. When the main body block 22 rotates clockwise in FIG. 3, the return spring 24 biases the main body block 22 to its return direction (the counterclockwise direction).

Since the guide member 19 has a simple configuration, the guide member 19 can be provided without difficulty even in a relatively small space like a space right under the feed base 5. This allows the vertical drive unit 9 to have a compact configuration.

Further, although not illustrated herein, it is preferable that the center of a reciprocation region for the square piece 18 in the guide groove 20 be set to the right side in the figure from the axial center of the pivot shaft 21 (the pivot shaft 21 of the guide member 19 is eccentric in the present embodiment). Hereby, when the guide groove 20 is inclined, the feed dog 3 can retreat below the throat plate 1 with a sufficient distance.

Figure 4:
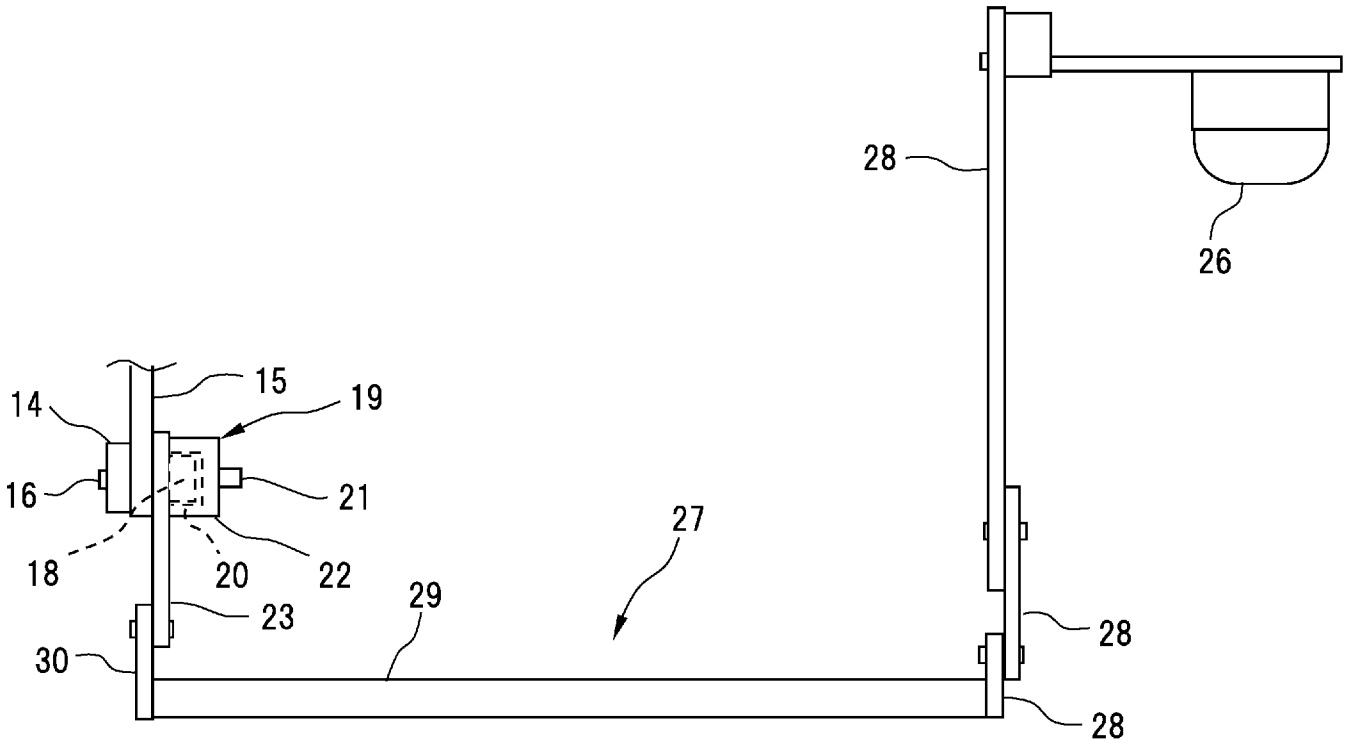
FIG. 4 is an explanatory view illustrating a configuration of an essential part of a guide member pivot mechanism.

As illustrated in FIG. 4, the guide member 19 is turned by operation of a press operation lever 26. The press operation lever 26 raises and lowers the presser foot 2 (see FIG. 1) by lifting and lowering operations on the press operation lever 26. The press operation lever 26 is connected to the presser foot 2 via a link mechanism (not shown) configured to cause vertical motion of the presser foot 2 to follow the lifting and lowering operations of the press operation lever 26.

That is, in a state where the press operation lever 26 is lowered, the presser foot 2 is brought into a state where the presser foot 2 makes press contact with fabric on the feed dog 3, and in a state where the press operation lever 26 is lifted, the presser foot 2 is separated from the fabric on the feed dog 3.

Further, as illustrated in FIG. 4, the guide member 19 is connected to the press operation lever 26 via a pivot link 27. The pivot link 27 includes a first link portion 28 configured to follow vertical motion of the press operation lever 26, a transmission shaft 29 via which vertical motion of the first link portion 28 is converted into turning motion and transmitted, and a second link portion 30 configured to transmit the turning motion of the transmission shaft 29 to the extension member 23 of the guide member 19. The pivot link 27 constitutes a guide member moving mechanism of the present invention.

When the press operation lever 26 is placed at a lower end within its operable range, the guide groove 20 of the guide member 19 becomes horizontal (corresponding to a second predetermined angle in the present invention) by the first link portion 28, the transmission shaft 29, and the second link portion 30.

When the lifting operation is performed on the press operation lever 26, the first link portion 28 moves along its longitudinal direction, so that the second link portion 30 turns the guide member 19 against biasing by the return spring 24 along with rotation of the transmission shaft 29. Hereby, the guide groove 20 of the guide member 19 is inclined.

The inclination angle of the guide groove 20 corresponds to the lifting operation angle of the press operation lever 26. That is, when the press operation lever 26 is placed at the lower end within its operable range, the guide groove 20 of the guide member 19 is horizontal. However, when the press operation lever 26 is placed at an upper end within its operable range, the guide groove 20 is inclined at a largest angle (corresponding to a first predetermined angle in the present invention) set in advance relative to the horizontal state. Further, when the press operation lever 26 is placed at an intermediate position between the upper end and the lower end within its operable range, the guide groove 20 is inclined at an angle (corresponding to a third predetermined angle in the present invention) smaller than the first predetermined angle in accordance with the angle of the press operation lever 26.

Note that, in the present embodiment, the upper end of the operable range of the press operation lever 26 corresponds to a first position in the present invention, the lower end of the operable range of the press operation lever 26 corresponds to a second position in the present invention, and the intermediate position between the upper end and the lower end of the operable range of the press operation lever 26 corresponds to a third position in the present invention.

By operating the press operation lever 26 to change the inclination angle of the guide groove 20 of the guide member 19, the feed dog 3 can retreat below the throat plate 1 when the presser foot 2 is separated from the throat plate 1, and the amount of feed of the fabric with the feed dog 3 can be adjusted by the operation position of the press operation lever 26.

Figure 5:
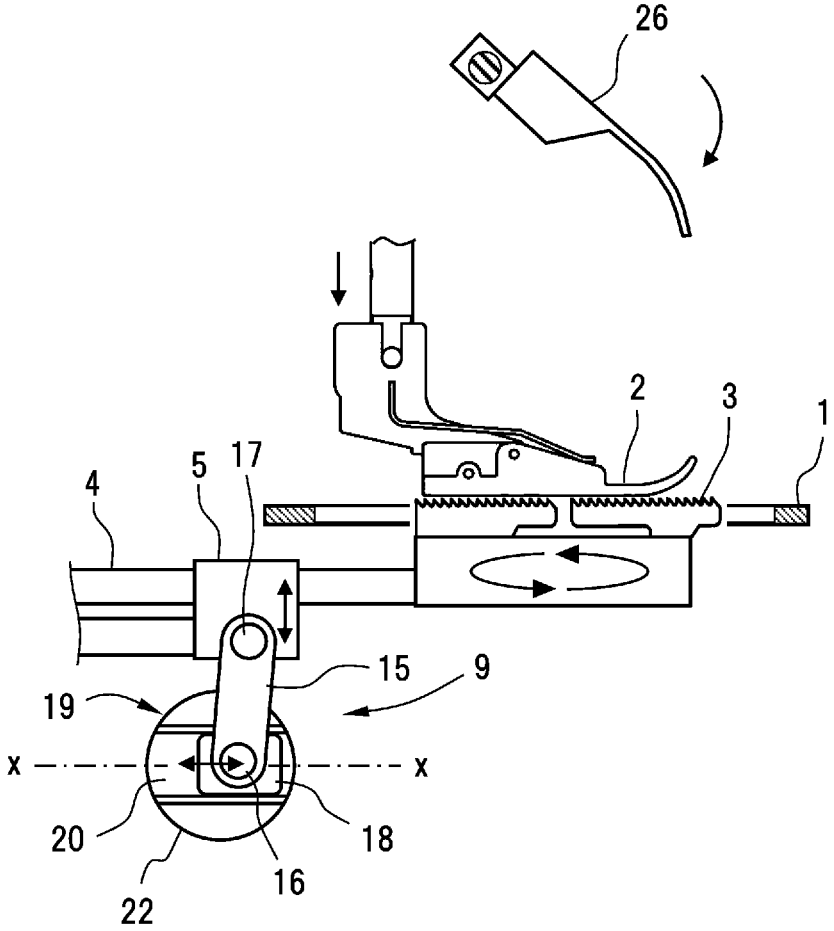
FIG. 5 is an explanatory view schematically illustrating a relationship between a position of a press operation lever and an operation of a feed dog.
Figure 6:
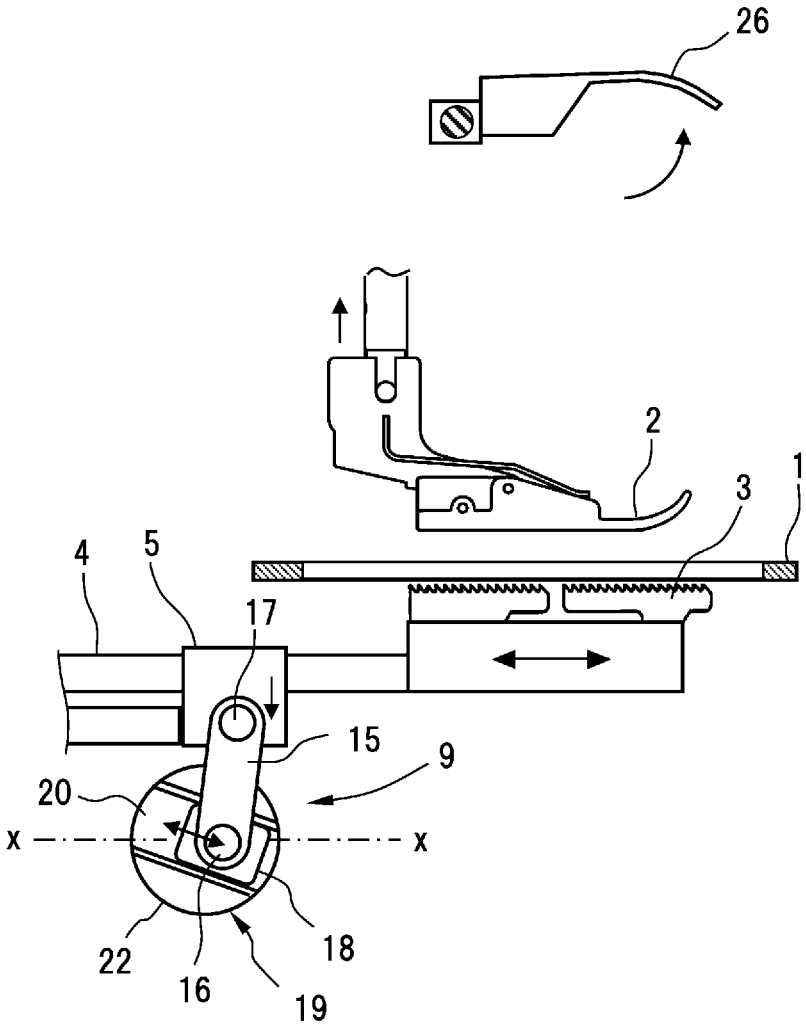
FIG. 6 is an explanatory view schematically illustrating a relationship between the position of the press operation lever and the operation of the feed dog when a guide groove is inclined at a first predetermined angle.
Figure 7:
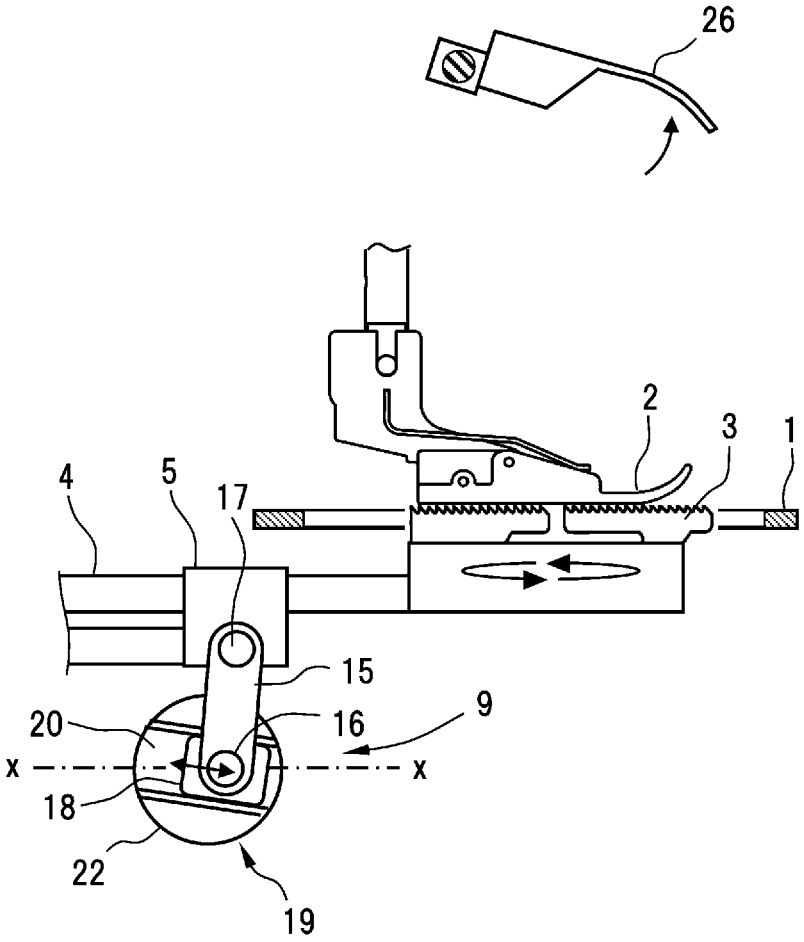
FIG. 7 is an explanatory view schematically illustrating a relationship between the position of the press operation lever and the operation of the feed dog when the guide groove is inclined at a second predetermined angle.

The operations of the presser foot 2 and the feed dog 3 along with the operation of the press operation lever 26 are schematically illustrated in FIGS. 5 to 7. Note that an alternate long and short dash line x in FIGS. 5 to 7 indicates a horizontal reference line in the guide groove 20.

As illustrated in FIG. 5, when the press operation lever 26 is placed at the lower end within the operable range, the presser foot 2 is brought into a state where the presser foot 2 makes press contact with the feed dog 3 at a lowered position. At this time, the sewing needle reciprocates in the up-down direction to perform a sewing operation on the fabric, and the fabric (not shown) is pressed by the presser foot 2 and the feed dog 3, although not illustrated herein.

Since the press operation lever 26 is placed at the lower end within the operable range, the guide groove 20 of the guide member 19 is horizontal. When the drive shaft 7 rotates and the second advance and retreat arm 14 advances and retreats in that state, the square piece 18 reciprocates to perform linear motion in the horizontal direction along the guide groove 20. When the second advance and retreat area 14 moves to an advanced position in sync with lifting of the sewing needle, the raising and lowering link 15 raises the feed base 5, and when the second advance and retreat arm 14 moves to a retreat position in sync with lowering of the sewing needle, the raising and lowering link 15 lowers the feed base 5.

Hereby, the feed dog 3 projects above the throat plate 1 and moves in the feeding direction of the fabric, so that the feed dog 3 can surely feed and move the fabric under sewing. When the feed dog 3 returns its original position, the feed dog 3 retracts below the throat plate 1, so that interference of the feed dog 3 with the fabric is prevented.

As illustrated in FIG. 6, when the press operation lever 26 is placed at the upper end within the operable range, the presser foot 2 is brought into a state where the presser foot 2 is separated from the throat plate 1. This state is a state established when the fabric is taken out from between the presser foot 2 and the throat plate 1 after the sewing operation is finished or when the fabric is set between the presser foot 2 and the throat plate 1 before the sewing operation starts.

Since the press operation lever 26 is placed at the upper end (the first position) within the operable range, the guide groove 20 of the guide member 19 is brought into an inclined state where the guide groove 20 is inclined at the largest inclination angle (the first predetermined angle). When the drive shaft 7 rotates and the second advance and retreat arm 14 advances and retreats in that state, the square piece 18 moves along the guide groove 20 in the inclined state. However, the upper end of the raising and lowering link 15 does not move in the up-down direction, so that the feed dog 3 only reciprocates at a position below the throat plate 1. Hereby, even when the sewing needle lifts, the feed dog 3 does not project above the throat plate 1, thereby making it possible to prevent interference of the fabric with the feed dog 3 and to smoothly perform an operation to take out the fabric from between the presser foot 2 and the throat plate 1 or to set the fabric between the presser foot 2 and the throat plate 1.

Further, as illustrated in FIG. 7, when the press operation lever 26 is placed at the intermediate position (the third position) between the upper end and the lower end within the operable range, the guide groove 20 of the guide member 19 is brought into an inclined state where the guide groove 20 is inclined at an angle (the third predetermined angle) larger than the horizontal state (the second predetermined angle) but smaller than the first predetermined angle while a state where the fabric is sandwiched between the presser foot 2 and the feed dog 3 is maintained. As a result, in comparison with a case where the guide groove 20 of the guide member 19 is inclined at the first predetermined angle, the raising and lowering motion of the feed base 5 by the raising and lowering link 15 along with the movement of the square piece 18 can be made small. When the raising and lowering motion of the feed base 5 is small, the moving distance of the feed dog 3 in a state projecting from the throat plate 1 is small, so that the amount of feed of the fabric is also small.

Thus, in the configuration of the present embodiment, not only the drive shaft 7 is disposed below the feed base 5, but also the guide member 19 and the raising and lowering link 15 are accommodated in a space below the feed base 5. This can achieve reduction of a high-performance sewing machine in size.

Note that, in the present embodiment, the guide groove 20 is set to be horizontal when the press operation lever 26 is placed at the lower end. However, the present invention is not limited to this. That is, the guide groove 20 may be set to become horizontal when the press operation lever 26 is placed at the upper end. Further, the angle (the second predetermined angle in the present invention) of the guide groove 20 during the sewing operation is not limited to being horizontal and can be set appropriately according to the dimension and so on of each part.

DESCRIPTION OF REFERENCE NUMERALS

1 . . . throat plate, 2 . . . presser foot, 3 . . . feed dog, 4 . . . feed connecting rod, 5 . . . feed base, 6 . . . swinging shaft, 7 . . . drive shaft, 8 . . . lateral feed drive unit, 9 . . . vertical drive unit, 13 . . . second eccentric cam (eccentric cam), 14 . . . second advance and retreat arm (advance and retreat arm), 15 . . . raising and lowering link, 16 . . . lower-part connecting shaft, 17 . . . upper-part connecting shaft, 18 . . . square piece, 19 . . . guide member, 21 . . . pivot shaft, 26 . . . press operation lever, 27 . . . pivot link (guide member pivot mechanism)

The invention claimed is:

1. A sewing machine comprising:

a feed dog configured to project from and retract into a top surface of a throat plate;

a presser foot facing an upper side of the feed dog;

a press operation lever configured to separate the presser foot from and bring the presser foot into press contact with the feed dog in conjunction with lifting and lowering operations; and a feed dog drive device configured to drive the feed dog, the feed dog drive device including, a feed connecting rod having a distal end that supports the feed dog, the feed connecting rod extending in a lateral direction, a feed base configured to support the feed connecting rod movably in a longitudinal direction of the feed connecting rod, a swinging shaft configured to swingably support a base end of the feed base such that the feed dog provided in the distal end of the feed connecting rod is movable in an up-down direction, a drive shaft via which power from a drive source is transmitted, a lateral feed drive unit configured to convert rotation of the drive shaft into lateral feed motion and transmit the lateral feed motion to the feed dog, and a vertical drive unit configured to convert rotation of the drive shaft into vertical motion and transmit the vertical motion to the feed dog, wherein:

the drive shaft is disposed below the feed base:

the vertical drive unit includes, an eccentric cam configured to be rotated by the drive shaft, an advance and retreat arm configured to advance and retreat in the lateral direction by the eccentric cam, a raising and lowering link having a lower end connected to the advance and retreat arm via a lower-part connecting shaft, and an upper end connected to the feed base via an upper-part connecting shaft, a square piece provided coaxially with the lower-part connecting shaft of the raising and lowering link, a guide member having a guide groove by which the square piece is linearly guided, a pivot shaft configured to turnably support the guide member, and a guide member pivot mechanism configured to change a moving distance of the feed dog in a state projecting from the throat plate by changing an inclination angle of the guide groove by turning the guide member;

the guide member is disposed on one side from the drive shaft and right under the feed base; and the raising and lowering link is connected to a part of the feed base between the swinging shaft and the feed dog.

2. The sewing machine according to claim 1, wherein:

the guide member pivot mechanism is constituted by a pivot link via which the press operation lever is connected to the guide member such that an operation of the press operation lever is interlocked with turning motion of the guide member; and the pivot link turns the guide member to an angle corresponding to a position of the press operation lever in the case where the press operation lever is operated.

3. The sewing machine according to claim 2, wherein:

in a case where the press operation lever is moved to a first position within an operable range of the press operation lever, the pivot link turns the guide member so that the guide groove is inclined at a first predetermined angle;

in a case where the press operation lever is positioned at a second position within the operable range, the pivot link turns the guide member so that the guide groove is inclined at a second predetermined angle; and in a case where the press operation lever is positioned at a third position within the operable range, the third position being between the first position and the second position, the pivot link turns the guide member so that the guide groove is inclined at a third predetermined angle between the first predetermined angle and the second predetermined angle.

4. The sewing machine according to claim 1, wherein a center of a reciprocation region for the square piece in the guide groove deviates from an axial center for turning of the guide member to a side where the guide groove is to be lowered in the case where the guide groove is inclined.

* * * * *